US005238398A

United States Patent [19]

Harris

[11] Patent Number: 5,238,398

[45] Date of Patent: Aug. 24, 1993

[54] VARIABLE ORIFICE GAS MODULATING VALVE

[75] Inventor: James A. Harris, Wichita, Kans.

[73] Assignee: Harmony Thermal Company, Inc., Greeley, Colo.

[21] Appl. No.: 716,514

[22] Filed: Jun. 17, 1991

[51] Int. Cl.[5] ..... F23D 14/62; F16K 3/00

[52] U.S. Cl. ..... 431/355; 251/205; 251/329; 126/39 R

[58] Field of Search ..... 431/355; 251/205, 326, 251/327, 129.01, 129.11, 129.19, 329; 126/39 R

[56] References Cited

U.S. PATENT DOCUMENTS

| | | | |
|---|---|---|---|
| 1,272,263 | 7/1918 | Hooker | 251/205 X |
| 1,283,907 | 11/1918 | Rigby | 251/205 X |
| 1,671,617 | 5/1928 | Spitzglass | 251/205 |
| 2,917,069 | 12/1959 | Lundy et al. | 251/205 X |
| 3,514,041 | 5/1970 | van Rooyen | 431/355 X |
| 4,043,535 | 8/1977 | Freeman et al. | 251/329 |
| 4,283,041 | 8/1981 | Kujawski | 251/205 |
| 4,794,907 | 1/1989 | Corliss et al. | 126/39 R |
| 5,020,774 | 6/1991 | Christianson | 251/205 X |
| 5,137,261 | 8/1992 | Clifford | 251/329 X |

*Primary Examiner*—Larry Jones

[57] ABSTRACT

A variable orifice gas modulating valve for use with an atmospheric Bunsen-type burner is disclosed. The variable orifice valve discharges a jet of fuel directly into the burner mixing tube and modulates the gas flow to the burner by changing the cross-sectional area of the gas jet. This is accomplished by a thin moveable sheet interposed between a valve body and a cap, through which pass the upstream and downstream portions of a short gas discharge passageway. The sheet has a hole which is positioned relative to the axis of the gas discharge passageway so as to produce a discharge orifice of variable size. The gas jet has the same velocity at all inputs, and flow rate variation is manifested by variation in the jet cross-sectional flow area. This contrasts with the conventional method for gas flow modulation for atmospheric burners wherein the gas jet issues from a fixed orifice and the gas pressure ahead of this orifice is modulated such that variable flow rate is manifested in a gas jet of constant cross-sectional flow area and variable velocity. These two methods of gas flow modulation result in quite different flame characteristics as the burner is turned down, and the variable orifice valve produces superior combustion characteristics at low input. The variable orifice gas valve also has the advantages of mechanical simplicity and linearity of heat input versus valve setting.

12 Claims, 2 Drawing Sheets

VARIABLE ORIFICE GAS MODULATING VALVE

BACKGROUND OF THE INVENTION

1. Field of the Invention

This invention relates to valves intended to vary or modulate the flow of gaseous fuel to an atmospheric burner in response to a change in load.

2. Discussion of the Background

It is often desirable in the design of gas-fired equipment, for instance instantaneous water heaters or circulating hot water boilers, to provide a gas fuel delivery apparatus that can automatically vary the flow of gas to the burner in response to a change in load. Regarding an instantaneous water heater, for example, water flows through the heat exchanger at variable rates depending on the hot water withdrawal rate at one or more remote taps. In addition to variable flow rate, the water may enter the heater at varying temperatures depending, for instance, on the season of the year. Since the intent of the heater is to deliver hot water at a specified temperature, it follows that the burner must deliver heat at a rate proportional to the flowrate through the heat exchanger and the temperature rise from inlet to outlet that accords with the desired outlet temperature. Many instantaneous water heaters incorporate a mechanism which varies the gas flowrate to the burner in response to changes in the load placed on the heater as described above.

A similar situation with regard to varying loads can pertain to hot water circulating boilers as well. In this case, the heat exchanger is part of a circuit through which water or some other fluid is pumped. In some instances, the flowrate through the heat exchanger can vary; for instance in a zone heating circuit served by one or more pumps. Also, a change in load can be reflected in a change in the temperature rise effected in the water passing through the heat exchanger. In some boiler applications, it is desirable to run the boiler at various outlet temperatures, depending for instance on the outdoor temperature (space heating application) or domestic hot water draw (for the case where the boiler also heats domestic water either directly or indirectly through another heat exchanger).

Modulating gas valves of various types have been used with both instantaneous water heaters and with circulating hot water boilers. Many of these heaters and/or boilers employ atmospheric Bunsen-type burners, and this discussion relates to these (as opposed to so-called power burners). Various moveable means are employed in these valves; some are mechanically actuated, some are pneumatically actuated, and some are electrically actuated. Regardless of the actuating means, however, these modulating valves all share a common characteristic, which is that their purpose is to modulate the pressure of the gas immediately upstream of a fixed orifice (or orifices) that discharges the gas into the mixing tube (or tubes) of a Bunsen-type atmospheric burner. To put it another way, gas flow modulation is effected by varying the gas pressure drop through a fixed orifice that discharges into the mixing tube of the burner. This may be called the first modulating method pertaining to Bunsen-type burners.

SUMMARY OF THE INVENTION

The invention disclosed herein employs the second method of modulating the gas flow to an atmospheric Bunsen-type burner. The second method is to vary the area of the discharge orifice while keeping the pressure drop across it constant. Thus, the variation in gas flow is effected by a variable orifice area with a constant pressure drop rather than by a constant orifice area with a variable pressure drop. A variable orifice may be achieved by several different mechanisms. One is the preferred embodiment of this invention, which effects a variable orifice with a single moving sheet interposed between the two halves of a short gas discharge passageway. Another mechanism can employ two sheets similarly interposed and moving in opposition to effect a variable orifice. Yet another mechanism is an iris-type shutter employing multiple moving sheets. Multiple sheet mechanisms can be used to insure that the gas discharge jet is always centered on the same axis, and in the case of the iris shutter, that the discharge jet is always nearly circular in cross-section. However, the single moveable sheet mechanism of the preferred embodiment is adequate for the operation of a Bunsen-type burner, despite the fact that at reduced flows the gas jet issuing from the variable orifice is neither perfectly centered in the mixer tube nor is it perfectly round in cross-section.

Three advantages can be cited for this invention. The first advantage is mechanical simplicity and ease of manufacture. The valve body is the only valve component which requires any machining. The other valve components can be stamped from sheet stock. The actuating mechanism for the moveable orifice sheet can also be very simple, as in the preferred embodiment, which shows a stepper motor which drives a threaded shaft-and-sleeve assembly to slide the moveable orifice sheet. Other actuators and/or drive linkages could be employed to slide the moveable orifice sheet, for instance a linear electromotive device or a pneumatic diaphragm-type device. The number of gas piping segments and connections is reduced, since the variable orifice modulating valve discharges directly into the mixer tube rather than into a pipe which further conveys the gas to a fixed orifice.

The second advantage relates to the linearity of the control means for high turndown ratios. For atmospheric Bunsen-type burners, it is possible to achieve a 5:1 turndown ratio consistent with good combustion characteristics. For a variable orifice valve, the gas discharge flowrate is directly proportional to the flow area of the orifice, neglecting minor changes in the discharge coefficient as the orifice is closed down. For the preferred embodiment of the invention, in which the orifice area is the intersection of two approximately equal circles, it is a straightforward exercise in geometry to show that the orifice area is close to a linear function of the distance between the centers of the two circles. Laboratory experiments using the preferred embodiment have also demonstrated that the gas discharge through the valve is very close to a linear function of the position of the moveable orifice sheet. Such a linear characteristic in the control means is a significant advantage with regard to the design of an automatic control system or algorithm. In contrast, a control system utilizing a modulating valve which throttles the gas flow in the line upstream of a fixed orifice (i.e. the first method), is faced with a somewhat more complicated situation. It is typical of such a system that the gas flowrate is a nonlinear function of the flow coefficient of the valve (i.e. the degree to which the valve is open). Generally for such a system, the flow is more sensitive to a change in valve position at low flows and less sensitive to a change in valve position at higher flows. This nonlinearity becomes quite pronounced in a system designed for a 5:1 turndown ratio. Such a nonlinearity in the control means complicates the design of a control system.

The third advantage relates to the fluid mechanics of primary air injection into the mixer tube of an atmospheric Bunsen-type burner. The quantity of primary air is generally measured as the percent of the total air which is necessary for complete combustion of the gas; this measure can be called "percent primary air". Thus, for a modulating Bunsen-type burner, if the flow rate of primary air into the mixer tube varies in direct proportion to the gas flow rate, then percent primary air is constant. In the first method of gas flow modulation, the variation in gas flow is manifested in a jet of gas which maintains a constant cross-sectional flow area and decreases in velocity as the burner is turned down. As a consequence of this, percent primary air stays fairly constant, usually decreasing slightly, as the burner is turned down. In the second method of gas flow modulation, the variation in gas flow is manifested in a jet of gas which maintains a constant velocity and decreases in cross-sectional flow area as the burner is turned down. As a consequence of this, percent primary air increases as the burner is turned down. The reason for the difference between the two methods in primary air injection capability can be readily understood by regarding the process in the throat of the mixing tube as one of momentum transfer. Given two gas jets of equal mass flowrate, the jet having higher velocity (with smaller flow area) has more momentum available to transfer to the quiescent surrounding air, and hence can draw more air into the mixer tube. The variable-orifice modulation method insures the highest possible gas jet velocity at all inputs, and thereby maximizes the primary air injection capability at a given gas manifold pressure. From the standpoint of burner operation, one cannot make an unconditional statement that one of these regimes is superior to the other in all cases. Burner head and port design relate to the modulation method to determine how the burner will perform over a range of inputs. However, it can be stated that the two modulation methods result in quite different burner behavior as the input is modulated. Which method is better will depend on the burner design. For instance, with a simple sheet metal "coffee can" burner head with slotted ports on the side, the second method of modulation has been found to give superior performance over a 5:1 turndown range. Consider two important flame characteristics: "hardness" (the degree of differentiation between the inner cone and the outer cone of a gas flame), and port velocity. In fitting the same "coffee can" burner with the first modulating means and then with the second modulating means, a significant difference in these flame characteristics is observed as the burner is turned down. With the first modulating means (fixed orifice, variable pressure), the flames become somewhat softer as the input is turned down, and port velocity becomes quite low, resulting in flames which hug the side of the burner rather than project out away from it. With the second modulating means (variable orifice, fixed pressure), the flames become harder as the input is turned down (consistent with increasing percent primary air), and port velocity stays high enough to project the flames out away from the side of the burner. The difference is also seen in analyzing the combustion products, particularly carbon monoxide, which indicates the completeness of combustion. With the first method, carbon monoxide concentration increases as the burner is turned down to its lowest input, indicating a degradation in the quality of combustion. With the second method, the carbon monoxide concentration stays substantially constant over the range of inputs, indicating good quality combustion over the whole range.

DETAILED DESCRIPTION OF THE PREFERRED EMBODIMENT

Figure 1:
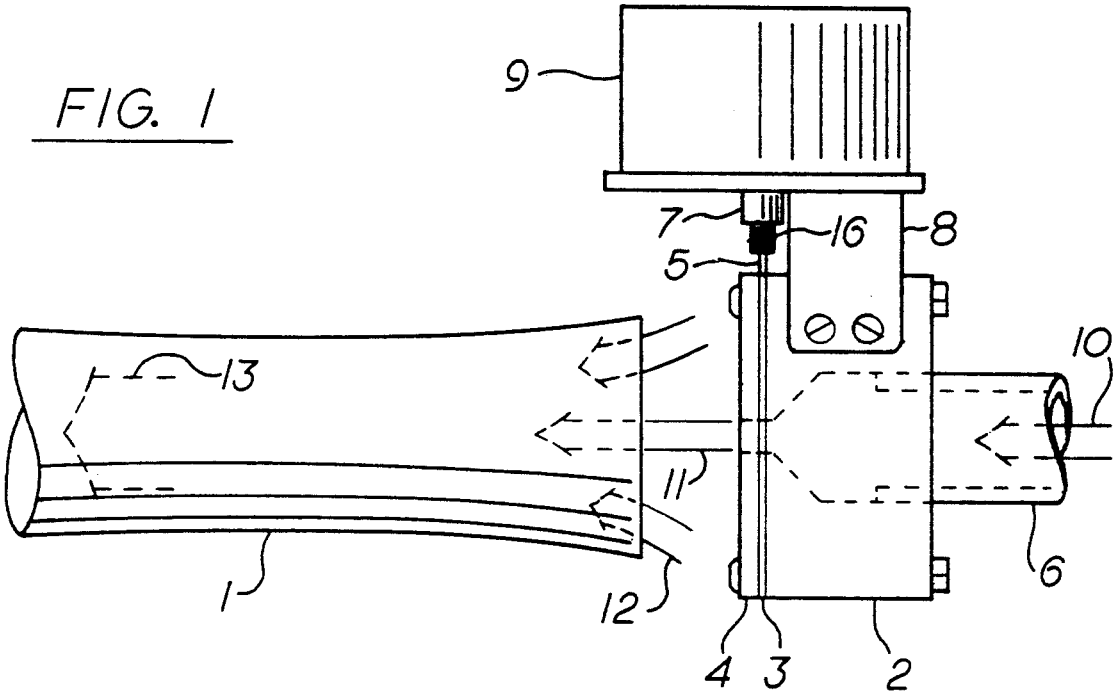
FIG. 1 shows a side external view of the variable orifice gas valve and its relationship to the mixing tube of a Bunsen-type atmospheric burner, and indicates the directions of flow for gas, the gas jet entering the mixing tube, primary air, and gas-primary air mixture.

FIG. 1 shows a side view of the gas valve assembly including valve body 2, slide holder 3, cap 4, and slide sheet 5 (see also FIG. 4 for an exploded view of these components), with gas line 6, conveying gaseous fuel 10 under pressure, connected to the valve body 2, and gas jet 11 discharging into the face of the mixer tube 1, which is connected to a burner head (not shown). The momentum of the gas jet 11 is transferred to the primary air 12, thereby drawing it into the mixer tube 1 where the gas and primary air are mixed and enter the burner head as the combustible mixture 13. Stepper motor 9 is attached to the valve body by mounting bracket 8. The stepper motor 9 is connected to the slide sheet 5 via the drive linkage and is actuated by a control signal from an electronic controller. The drive linkage comprises a threaded sleeve 7 which is turned directly by the motor 9, and a threaded shaft 16 with the lower end attached directly to the slide sheet 5 by some convenient means. Threaded shaft 16 is thus constrained from rotational motion. A portion of the threaded shaft 16 is engaged in the threaded sleeve 7 so that rotation of threaded sleeve 7 causes a linear motion of the threaded shaft 16; this linear motion is transferred directly to slide sheet 5.

The valve effects variation in the gas flow rate by varying the cross-sectional area of the gas jet 11. The manner by which this is accomplished can be fully understood by reference to FIGS. 2, 3, and 4. FIG. 4 shows an exploded view of the valve. Gas flows through the valve from right to left. The valve body 2 has an opening on the right (as seen in FIG. 1) to which is attached the gas line 6. The gas flow conduit through the valve body 2 necks down from right to left (as indicated in FIG. 1) and emerges from the valve body 2 at the circular inlet port 14. The cap 4 has a circular outlet port 15 which is the same diameter as inlet port 14. When the valve is assembled, cap 4 is immovably mounted to valve body 2 such that the centers of ports 14 and 15 are coaxial, so as to effect a contiguous gas discharge passageway. Between valve body 2 and cap 4, the slide sheet 5 and the horseshoe-shaped slide holder 3 are sandwiched. Slide sheet 5 has a circular hole which is positioned to align totally or partially with the ports in valve body 2 and cap 4, depending on the position of slide sheet 5, so as to effect a discharge orifice of variable size. The inside dimensions of the cutout portion of slide holder 3 constrain slide sheet 5 to vertical travel and limit the extent of the vertical travel. With the slide sheet at its uppermost position, the valve is wide open. With the slide sheet at its lowermost position, the valve is at its minimum opening. The valve does not permit a gas flowrate less than the minimum, thereby preventing the burner from operating at less than its designed minimum input.

Figure 2:
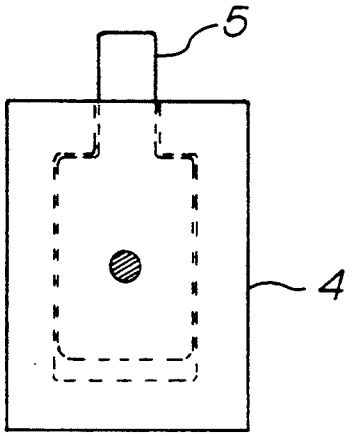
FIG. 2 shows the position of the slide sheet when the valve is wide open.
Figure 3:
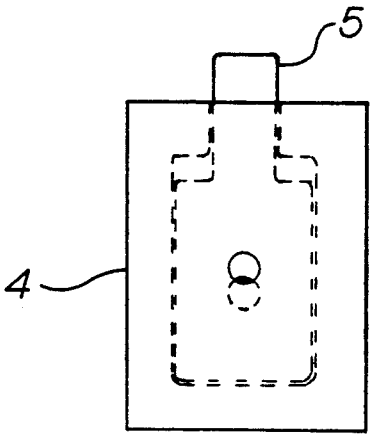
FIG. 3 shows the position of the slide sheet when the valve is partially closed.
Figure 4:
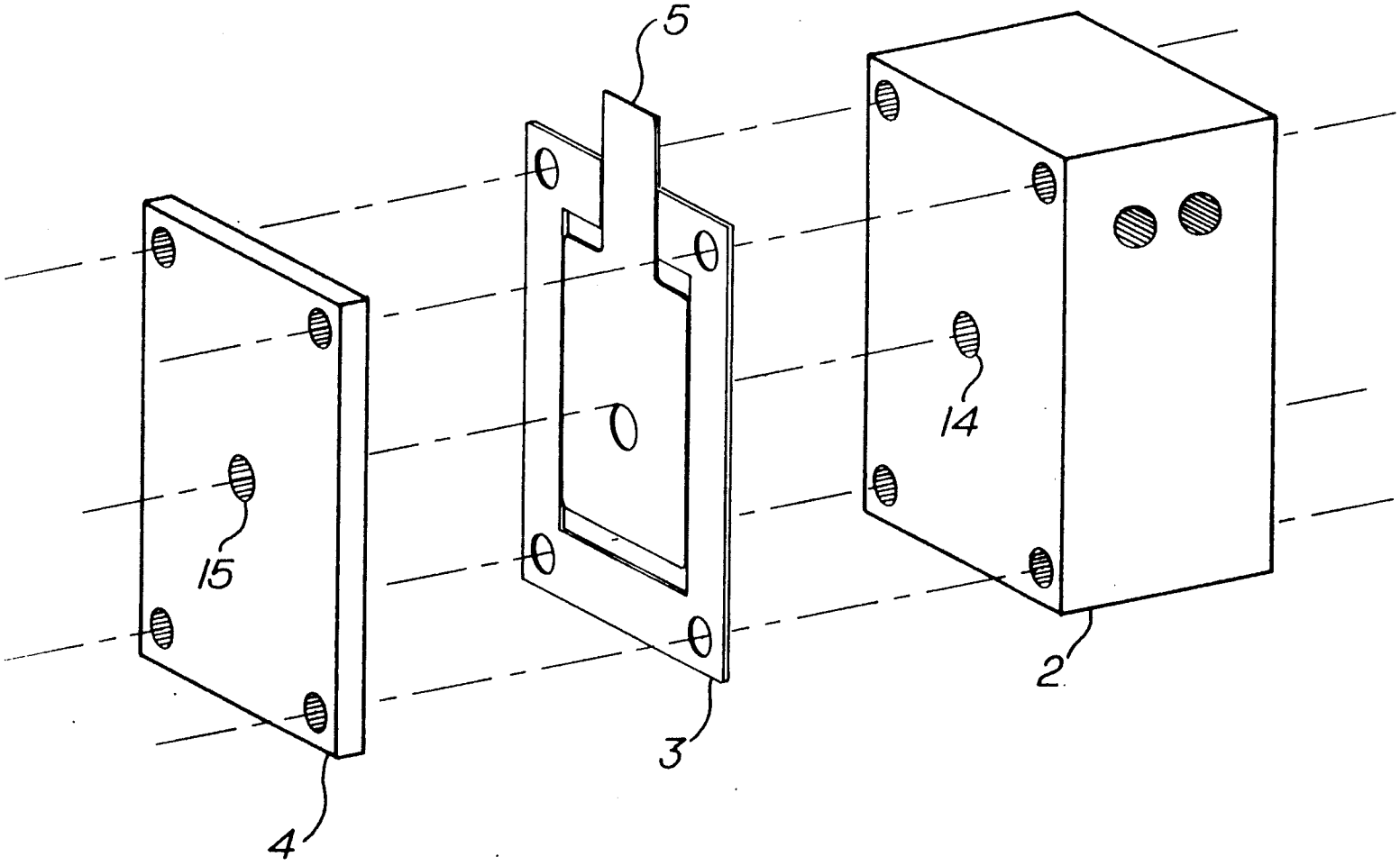
FIG. 4 shows an exploded view of the variable orifice valve.

FIGS. 2 and 3 show the valve outlet looking from the mixer tube face. The motion of slide sheet 5 varies the size of the discharge orifice from which the gas jet 11 issues; the orifice area is indicated by the hatched portion in FIGS. 2 and 3. In FIG. 2, the valve is wide open; in FIG. 3, it is partially closed.

The slide sheet 5 can be made from thin shim stock. A thickness of 0.010 inches works well, although the thickness is not critical. The slide holder 3 can be made from shim stock which is slightly thicker than slide sheet 5 so that the slide sheet 5 will slide easily. A petroleum-based gas valve lubricant can be used to minimize sliding friction and eliminate gas leakage out the top of the valve. The circular hole in the slide sheet 5 is typically made slightly larger than ports 14 and 15. This insures that slight dimensional inaccuracies do not result in a restriction of gas flow when the valve is wide open.

The thickness of the cap 4 will generally be on the order of 0.10 inches. It should be thick enough to be structurally rigid, but not too thick to interfere with the gas jet issuing from the orifice. The design principle guiding the geometry of the inlet and outlet ports is to make the gas flow path when the valve is wide open similar to that of a conventional fixed orifice spud, which typically has a convergent inlet followed by a straight bore having length on the order of diameter. Following this general principle, the wide-open discharge coefficient of the variable-orifice valve will be close in magnitude to the discharge coefficient of a fixed orifice spud having the same diameter; this discharge coefficient is generally in the range 0.7–0.9. Thus, the diameter of the valve ports for a given maximum input can be closely approximated for design purposes by reference to a standard table giving heat input versus orifice diameter for various gaseous fuels and manifold pressures.

While a preferred embodiment of this invention has been shown and described, it is understood that the invention is not limited thereto. In view of the foregoing teachings, modifications may be made within the scope of this invention by one of ordinary skill in the art to which this invention pertains. For example, the hole in the slide sheet 5 need not necessarily be circular, but could be some other convenient shape. The inlet port 14 and the outlet port 15 could also be non-circular. For instance, if the hole and ports were made in a diamond shape, vertical motion of the slide sheet 5 would effect a diamond-shaped orifice of variable size. Also, the slide sheet could be rotated on a pivot so as to effect movement of the slide sheet hole along an arc which passes through the axis of the gas discharge passageway. The cutout portion of the slide holder could be shaped to accomodate this type of motion and to define its limits in a manner similar to the linear motion embodiment which has been described in detail. Various drive mechanisms for effecting this rotational movement could be designed. Also, other mechanisms to vary the orifice size could be interposed between the valve body 2 and the cap 4. One such mechanism could utilize two sheets which slide in opposition so as to maintain the center of the orifice at the same location for all settings. Another such mechanism could be an iris made up of multiple sliding sheets which effect a central orifice. There are also variations in the drive mechanism which could be employed. For instance, the roles of the threaded sleeve and the threaded shaft could be reversed, such that the threaded shaft is rotated by the stepper motor and the threaded sleeve is attached to the slide sheet 5 and is constrained from rotation.

It should also be noted that a means would generally be utilized for attaching the mixer tube to the variable orifice valve, thereby insuring proper alignment of the gas jet discharging into the mixer tube. Such a means has been omitted from the drawings for the sake of clarity in describing the fundamental nature of the invention. Such an attachment means could take many forms. For instance, the end of the mixer tube could be attached directly to the cap of the variable orifice valve, and slotted openings placed in the side of the mixer tube to admit primary air. The prior art shows many ways of mounting and aligning a mixer tube with a fixed orifice spud, and similar ways of doing this may be employed with the variable orifice valve in place of a fixed orifice spud.

What is claimed is:

1. An automatic gas modulating valve for regulating the flow of gaseous fuel from a fuel source to a gas burner, comprising a first valve body member having a first generally planar slide surface and a gas inlet opening communicatively connected to a gas flow conduit extending through the first valve body member and terminating in an inlet port formed in the first planar slide surface;

a second valve body member fixed to the first valve body member and including a second generally planar slide surface disposed parallel to and spaced from the first planar slide surface of the first valve body member so as to define a relatively thin planar slide cavity between the first valve body member and the second valve body member, the sound valve body member having an outlet port formed in the second planar slide surface in coaxial relation to said inlet port so as to form a contiguous gas discharge passageway between the inlet port of the first valve body member and the outlet port of the second valve body member;

a moveable slide sheet which is slightly thinner than the width of said thin planar slide cavity, having an opening formed therein, and sandwiched within said thin planar slide cavity, said slide sheet being moveable back and forth within the planar slide cavity, the opening of the slide sheet being interposed between the inlet and outlet ports such that the sliding motion of the slide sheet varies the position of the slide sheet opening relative to the inlet and outlet ports so as to form a variable orifice within the gas discharge passageway, whereby the flow of gas from the source to the burner is modulated and controlled by the sliding movement of the slide sheet;

means to constrain the movement of the slide sheet between two extreme positions, corresponding to two sizes of said variable orifice, such that the flow of gaseous fuel is constrained to be a rate between a maximum rate and a nonzero minimum rate, whereby a flow of gas less than the minimum rate is not permitted, and a flow of gas greater than the maximum rate is not permitted;

sealing means to minimize the leakage of fuel gas from the valve structure to the surroundings;

an automatic actuator which is responsive to a control signal and which is associated with the gas modulating valve for positioning the slide sheet within the planar slide cavity at a position between said two extreme positions, whereby automatic modulating control of the gas flow may be effected; and connecting means connected between the automatic actuator and the slide sheet for sliding the slide sheet back and forth in response to the actuation of the actuator.

2. The automatic gas modulating valve of claim 1 in which the two extreme positions of the slide sheet are established by the boundaries of the thin planar slide cavity.

3. The automatic gas modulating valve of claim 1 in which the sealing means consists of a lubricating material in the thin planar gap between the planar surface of the first valve body member and the first planar sliding surface of the slide sheet, and in the thin planar gap between the planar surface of the second valve body member and the second planar sliding surface of the slide sheet, whereby said lubricating material minimizes the sliding friction associated with the moving slide sheet and also provides a seal to minimize gas leakage from the valve assembly.

4. The automatic gas modulating valve of claim 1 in which the second valve body member is a valve cap fixed to the first valve body member and having the outlet port disposed so as to direct a jet of gaseous fuel directly into a mixer tube of an atmospheric Bunsen-type burner.

5. The automatic gas modulating valve of claim 1 in which the automatic actuator is an electric motor, and the connecting means is a drive linkage comprising a threaded sleeve rotated by the electric motor;

a threaded shaft having one end engaged in the threaded sleeve and the other end fixed to the slide sheet such that the rotation of the threaded sleeve causes the threaded shaft to move linearly, which thereby causes the slide sheet to move.

6. The automatic gas modulating valve of claim 1 in which the automatic actuator is an electric motor, and the connecting means is a drive linkage comprising a threaded shaft rotated by the electric motor;

a threaded sleeve engaged upon the threaded shaft and fixed to the slide sheet such that the rotation of the threaded shaft causes the threaded sleeve to move linearly, which thereby causes the slide sheet to move.

7. The automatic gas modulating valve of claim 1 in which the automatic actuator is a stepper motor, and the connecting means is a drive linkage comprising a threaded sleeve rotated by the stepper motor;

a threaded shaft having one end engaged in the threaded sleeve and the other end fixed to the slide sheet such that the rotation of the threaded sleeve causes the threaded shaft to move linearly, which thereby causes the slide sheet to move.

8. The automatic gas modulating valve of claim 1 in which the automatic actuator is a stepper motor, and the connecting means is a drive linkage comprising a threaded shaft rotated by the stepper motor;

a threaded sleeve engaged upon the threaded shaft and fixed to the slide sheet such that the rotation of the threaded shaft causes the threaded sleeve to move linearly, which thereby causes the slide sheet to move.

9. The automatic gas modulating valve of claim 1 which further includes a thin slide holder immovably sandwiched between the planar slide surfaces of the first and second valve body members, said slide holder having a cutout portion so as to effect said thin planar cavity between the slide surfaces.

10. The automatic gas modulating valve of claim 1 which further includes a thin slide holder immovably sandwiched between the planar slide surfaces of the first and second valve body members, said slide holder having a cutout portion so as to effect said thin planar cavity between the slide surfaces and further to effect boundaries which establish the two extreme positions which limit the movement of the slide sheet.

11. The automatic gas modulating valve of claim 1 in which said moveable slide sheet has a shape comprising two portions, namely a first portion which is rectangular and which is constrained to locations within said slide cavity, and a second portion which is relatively narrow and which extends in part outside the valve body for connection to the automatic actuator and connecting means, such that a pair of shoulders is formed where the first portion adjoins the second portion; and in which said thin planar slide cavity is also rectangular in shape so that its two side boundaries accomodate the width of the first portion of the slide sheet and permit slide sheet motion in one direction only, and having an opening in the center of the top boundary to accomodate the second portion of the slide sheet, whereby the linear motion of the slide sheet is constrained at one end by the shoulders meeting the top boundary of the slide cavity, and is constrained at the other end by the slide sheet meeting the bottom boundary of the slide cavity.

12. The automatic gas modulating valve of claim 1 in which said moveable slide sheet has a shape comprising two portions, namely a first portion which is rectangular and which is constrained to locations within said slide cavity, and a second portion which is relatively narrow and which extends in part outside the valve body for connection to the automatic actuator and connecting means, such that a pair of shoulders is formed where the first portion adjoins the second portion; and which further includes a thin slide holder sandwiched between the planar slide surfaces of the first and second valve body members, said slide holder having a cutout portion which establishes said thin planar slide cavity, which is also rectangular in shape so that its two side boundaries accomodate the width of the first portion of the slide sheet and permit slide sheet motion in one direction only, and which has an opening in the center of the top boundary to accomodate the second portion of the slide sheet, whereby the linear motion of the slide sheet is constrained at one end by the shoulders meeting the top boundary of the slide cavity, and is constrained at the other end by the slide sheet meeting the bottom boundary of the slide cavity.

* * * * *